US012508475B2

(12) United States Patent
Shiue

(10) Patent No.: US 12,508,475 B2
(45) Date of Patent: Dec. 30, 2025

(54) WATER SPORTS MASK

(71) Applicant: QBAS Co., Ltd., Taipei (TW)

(72) Inventor: Chih-Cheng Shiue, Taipei (TW)

(73) Assignee: QBAS CO., LTD., Taipei (TW)

( * ) Notice: Subject to any disclaimer, the term of this patent is extended or adjusted under 35 U.S.C. 154(b) by 0 days.

(21) Appl. No.: 19/188,288

(22) Filed: Apr. 24, 2025

(65) Prior Publication Data

US 2025/0332481 A1 Oct. 30, 2025

Related U.S. Application Data

(60) Provisional application No. 63/639,350, filed on Apr. 26, 2024.

(51) Int. Cl.
*A63B 33/00* (2006.01)
*B63C 11/12* (2006.01)

(52) U.S. Cl.
CPC ..... *A63B 33/002* (2013.01); *B63C 11/12* (2013.01)

(58) Field of Classification Search
CPC . B63C 11/12; B63C 2011/128; A63B 33/002; A63B 33/004; A63B 33/006; A63B 33/008; A61F 9/02; A61F 9/025; A61F 9/026; A61F 9/029
USPC ... 2/441, 443, 426, 431, 439, 440, 442, 444, 2/445
See application file for complete search history.

(56) References Cited

U.S. PATENT DOCUMENTS 5,555,571 A * 9/1996 McCaffrey ..... B63C 11/12 2/454
6,349,419 B1 * 2/2002 Chiang ..... A63B 33/004 2/452
11,731,746 B2 * 8/2023 Fujimoto ..... B63C 11/12 2/427
2004/0163163 A1 * 8/2004 Shiue ..... B63C 11/12 2/428
2005/0193479 A1 * 9/2005 Atta ..... A63B 33/004 2/440
2006/0107446 A1 * 5/2006 Shiue ..... B63C 11/12 2/428
2006/0221298 A1 * 10/2006 Matsumoto ..... G02C 1/00 351/43
2006/0242753 A1 * 11/2006 Shiue ..... B63C 11/12 2/447
2009/0193568 A1 * 8/2009 Shiue ..... B63C 11/12 2/443

(Continued)

FOREIGN PATENT DOCUMENTS

DE 202024105017 U1 * 10/2024 ..... B63C 11/12
GB 2579706 A * 7/2020 ..... A63B 33/002

*Primary Examiner* — Amy Vanatta
(74) *Attorney, Agent, or Firm* — MUNCY, GEISSLER, OLDS & LOWE, P.C.

(57) ABSTRACT

A water sports mask is provided, which includes a waterproof skirt, a left viewing window, a right viewing window, a head strap and a frame. Left and right skirt portions of the waterproof skirt define left and right hollow front portions, respectively. The left and right viewing windows are embedded with the left and right hollow front portions, respectively, and each of them has a width ranging from 30 mm to 60 mm, and a height ranging from 20 mm to 50 mm. The frame is detachably installed onto the waterproof skirt along peripheries of the left and right hollow front portions thereof.

14 Claims, 13 Drawing Sheets

(56) References Cited

U.S. PATENT DOCUMENTS

| | | | | |
|---|---|---|---|---|
| 2009/0300812 | A1* | 12/2009 | Shiue | B63C 11/12 2/15 |
| 2010/0199411 | A1* | 8/2010 | Kaiser | A63B 33/00 2/446 |
| 2020/0001955 | A1* | 1/2020 | Friscione | B63C 11/12 |
| 2023/0088521 | A1* | 3/2023 | Shiue | A63B 33/002 2/440 |
| 2025/0025749 | A1* | 1/2025 | Shiue | A63B 33/004 |
| 2025/0074560 | A1* | 3/2025 | Shiue | B63C 11/16 |
| 2025/0303233 | A1* | 10/2025 | Shiue | A63B 33/004 |

* cited by examiner

WATER SPORTS MASK

CROSS-REFERENCES TO RELATED APPLICATIONS

This patent application claims the benefit of U.S. Prov. Ser. No. 63/639,350 filed on Apr. 26, 2024, which is incorporated in its entirety by reference.

BACKGROUND OF THE INVENTION

Field of the Invention

The present invention relates to a water sports mask, especially a mask used for swimming, snorkeling, freediving, spearfishing or other water activities (including both surface and underwater activities), in which the mask usually covers the user's eyes and nose.

Description of the Related Art

Current masks for water activities commonly include, for example, swimming goggles that cover only the eyes or snorkel masks that cover both the eyes and nose. There are also other masks with similar structures to snorkel masks, such as general diving masks, training goggles, and masks for freediving and spearfishing. Later on, full-face breathable masks that cover the eyes, nose, and mouth were also developed.

In order to avoid discomfort caused by the hard portions (i.e., the frame and the viewing windows) of the snorkel mask touching the user's face (especially the bridge and root of the nose), those portions must be designed to protrude forward, thus establishing a certain distance away from the user's face. As such, in terms of the field of vision, to ensure an adequate field of vision for water activities, the size of the viewing windows must inherently be large to a certain extent. However, these designs are obviously not conducive to making the mask compact and lightweight.

In addition, in terms of structure, tempered glass is generally used to enhance the strength of large viewing windows. This undoubtedly significantly increases the weight of the region where the viewing windows are located, causing the entire front portion of the mask to be pulled downward. Consequently, the watertightness of the rear portion of the waterproof skirt (i.e., the portion of the waterproof skirt fitting closely to the user's face) would be affected. Therefore, it is necessary to increase the wall thickness of the waterproof skirt (especially the thickness of the two sides and the top thereof) to reinforce the mask body and to equalize the weight of the front and rear portions of the mask so as to provide the mask to have better wearing balance and stability. It is conceivable that the current designs make it impossible for the masks to be miniaturized, easy to use, and convenient to carry.

On the other hand, when freediving, spearfishing or swimming training, the user cannot breathe while wearing the mask covering the eyes and nose. The user must take a deep breath and hold it to complete the required activities within a certain period of time. Therefore, if the inner volume of the mask is too large, the space inside the mask will be compressed by water pressure, pressing against the user's face. Consequently, users often have to exhale a small amount of air to equalize the pressure inside the mask. In other words, the larger the inner volume of the mask, the greater the amount of air that needs to be exhaled. Such a compromise on breath-holding will seriously affect the duration of activities. This is another reason why the inner volume of the mask cannot be designed too large.

In view of this, the industry is striving to design a water sports mask that can solve some or all of the above problems to provide the advantages of miniaturization, better face-fitting, and sufficient strength.

SUMMARY OF THE INVENTION

The main objective of the present invention is to provide a water sports mask. Taking the water sports mask covering the eyes and nose as an example, it does not require internal airflow passages. Instead, it only needs to ensure watertightness, which is typically achieved by the rear portion of the soft, face-fitting waterproof skirt. Therefore, a good seal between the front portion of the waterproof skirt and the viewing windows is sufficient for watertightness.

In addition, the frame, often made of hard material, reinforces the entire structure of the mask, and due to its position at the very front, also shows the product's unique appearance. This is a major consideration for consumers when making a purchase. However, the frame does not need to provide a watertight function.

In view of this, the present invention provides a pair of relatively small viewing windows embedded with a waterproof skirt having corresponding hollow front portions. The waterproof skirt covers the user's eyes and nose while maintaining watertightness with the user's face. In order to achieve the product's unique appearance, the present invention further provides a compact frame, which can optionally be installed onto the waterproof skirt according to the user's preference. When choosing not to use it, the user can easily detach it from the waterproof skirt. The compact frame is not only convenient for storage and reusable, but can also be designed in different styles and colors for replacement. In certain designs, the present invention can also allow the waterproof skirt and the frame to remain relatively movable so that the waterproof skirt can more closely fit the user's face without being constrained by the hard frame. For activities like freediving, spearfishing or swimming training, because the space inside the mask is extremely small, the user does not need to exhale part of the air that he/she has inhaled and held in advance to balance the pressure inside and outside the mask. This way will make the underwater activities longer and more enjoyable.

To achieve the above objective, the present invention discloses a water sports mask. The water sports mask includes a waterproof skirt, a left viewing window, a right viewing window, a head strap and a frame. The waterproof skirt has a left skirt portion, a right skirt portion, a nose covering portion and a rear portion. The left skirt portion defines a right hollow front portion. The right skirt portion defines a right hollow front portion. The nose covering portion is integrally formed between the left skirt portion and the right skirt portion. The rear portion is configured to fit around eyes and a nose of a user only. The left viewing window is embedded with the left hollow front portion. The right viewing window is embedded with the right hollow front portion. The head strap runs backward along a left side and a right side of the waterproof skirt. The left viewing window and the right viewing window each have a width ranging from 30 mm to 60 mm, and a height ranging from 20 mm to 50 mm. The frame is detachably installed onto the waterproof skirt along peripheries of the left and right hollow front portions thereof.

In an example, the left viewing window and the right viewing window constitute a two-piece viewing window with separate left and right faceplates.

In an example, the frame comprises a left frame, a right frame and a bridge connecting the left frame and the right frame, and peripheral edges of the left hollow front portion and the right hollow front portion of the waterproof skirt have matching contours with the left frame and the right frame, respectively.

In an implementation, the left frame has at least one first engaging slot for accommodating a first periphery of the left hollow front portion, and the right frame has at least one second engaging slot for accommodating a second periphery of the right hollow front portion.

In an example, the at least one first engaging slot of the left frame comprises three first engaging slots evenly distributed on the left frame, and the at least one second engaging slot of the right frame comprises three second engaging slots evenly distributed on the right frame.

In another implementation, the left frame has at least one first snap hole, and the right frame has at least one second snap hole, and wherein the left skirt portion has at least one first snap block, and the right skirt portion has at least one second snap block so that when the frame is installed onto the waterproof skirt, the at least one first snap block is correspondingly engaged in the at least one first snap hole, and the at least one second snap block is correspondingly engaged in the at least one second snap hole.

In an example, the at least one first snap hole of the left frame includes two first snap holes, respectively located at an upper frame section and a lower frame section of the left frame, and the at least one second snap hole of the right frame includes two second snap holes, respectively located at an upper frame section and a lower frame section of the right frame. Moreover, the at least one first snap block of the left skirt portion includes two first snap blocks, respectively located at an upper portion and a lower portion of the left skirt portion, and the at least one second snap block of the right skirt portion includes two second snap blocks, respectively located at an upper portion and a lower portion of the right skirt portion.

In an example, the waterproof skirt further includes a recessed portion extending along at least one portion of the outer contour of the frame.

In yet another implementation, the left viewing window has a first side groove defined by a first outer sidewall and a first inner sidewall opposite to the first outer sidewall, and the right viewing window has a second side groove defined by a second outer sidewall and a second inner sidewall opposite to the second outer sidewall. The first inner sidewall and the second inner sidewall are embedded in the left hollow front portion and the right hollow front portion, respectively. Moreover, the left frame has at least one first hold-down for engaging with the first outer sidewall of the first side groove, and the right frame has at least one second hold-down for engaging with the second outer sidewall of the second side groove to fix the frame onto the waterproof skirt.

In an example, the at least one first hold-down of the left frame comprises three first hold-downs evenly distributed on the left frame, and the at least one second hold-down of the right frame comprises three second hold-downs evenly distributed on the right frame.

In an example, the waterproof skirt further includes a recessed portion extending along at least one portion of the outer contour of the frame.

In a further implementation, the water sports mask of the present invention further includes a pivotable device disposed on two opposing outer sides of the frame for detachably installing the frame onto the waterproof skirt.

In an example, the pivotable device includes a left pin and a right pin each having a substantially cane-shaped structure. The left pin is inserted through outer side vias of the left frame and the left skirt portion, and the right pin is inserted through outer side vias of the right frame and the right skirt portion so that the waterproof skirt and the frame are configured to pivot relative to each other along the left pin and the right pin.

In an example, the left frame is provided with a first fixing hole, and the right frame is provided with a second fixing hole. A first head of the left pin has a first latch, and a second head of the right pin has a second latch so that the first latch and the second latch are inserted into the first fixed hole and the second fixed hole, respectively, to lock the left pin and the right pin on the left frame and the right frame to prevent the frame from being completely separated from the waterproof skirt.

DESCRIPTION OF THE PREFERRED EMBODIMENT

Figure 1A:
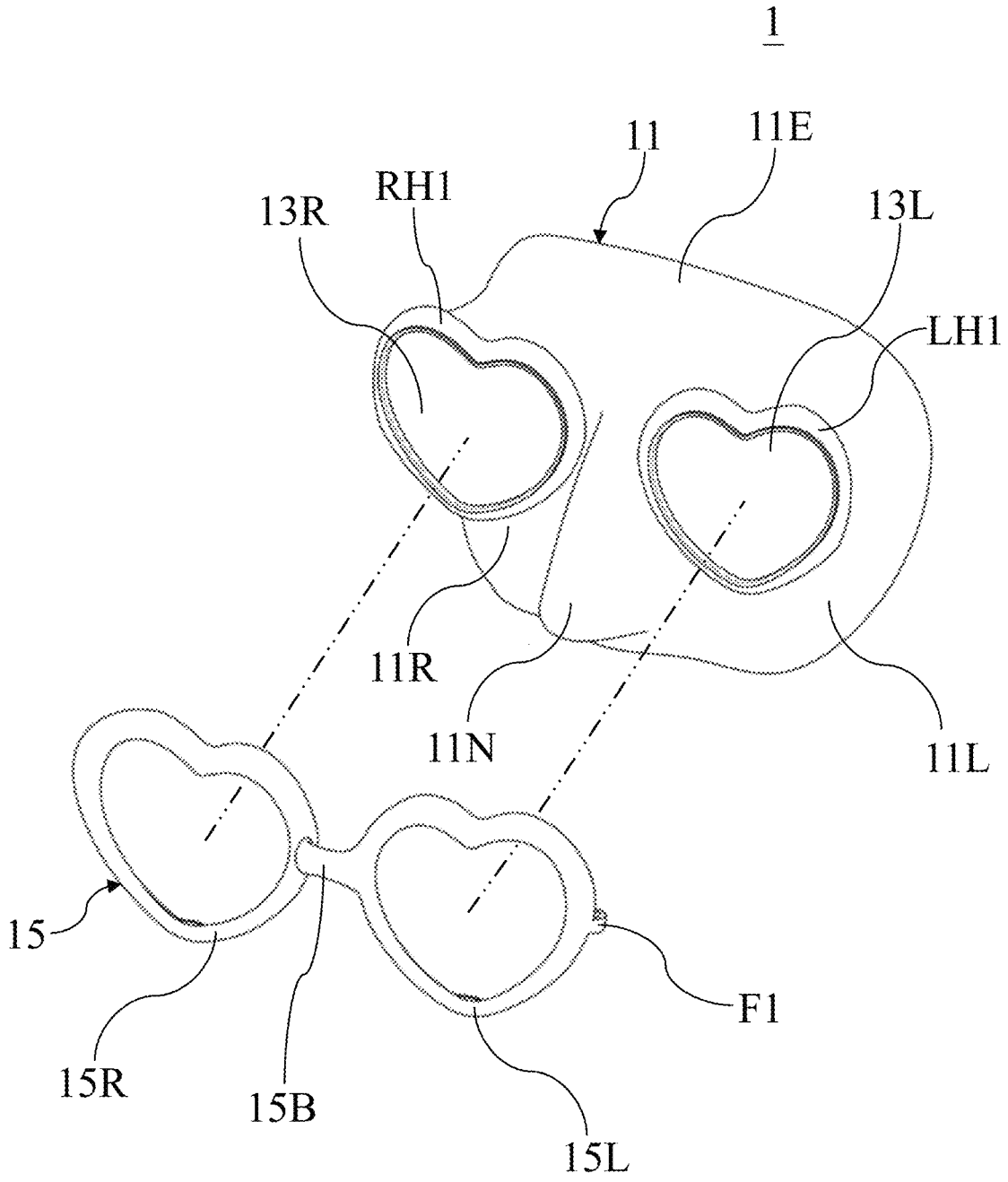
FIG. 1A is a schematic perspective view of a water sports mask (with the head strap omitted for clarity) according to a first embodiment of the present invention, in which the frame has not yet been installed onto the waterproof skirt.

It shall be appreciated that the following description of each embodiment is only to explain the contents of the present invention, but not to limit the invention as claimed. Elements not directly related to the present invention are omitted from the description, and the dimensions as depicted for all elements in the drawings are just for easy understanding and do not intend to limit their actual scales. In addition, the used "upper," "lower," "front," "back," "left," "right," "inner," "outer," or the like adjectives defined in the descriptions are referred to by the direction of the user himself/herself. They are only relative relationships and are not limitative. When the element names involve "first" and "second," and only the detailed structure of one of them is described, it means that both have the same structure, especially a symmetrical structure. Their following description will not be repeated. In addition, in order to make the parts of the drawings clear, some necessary parts (such as a head strap) are omitted in some drawings.

Figure 1B:
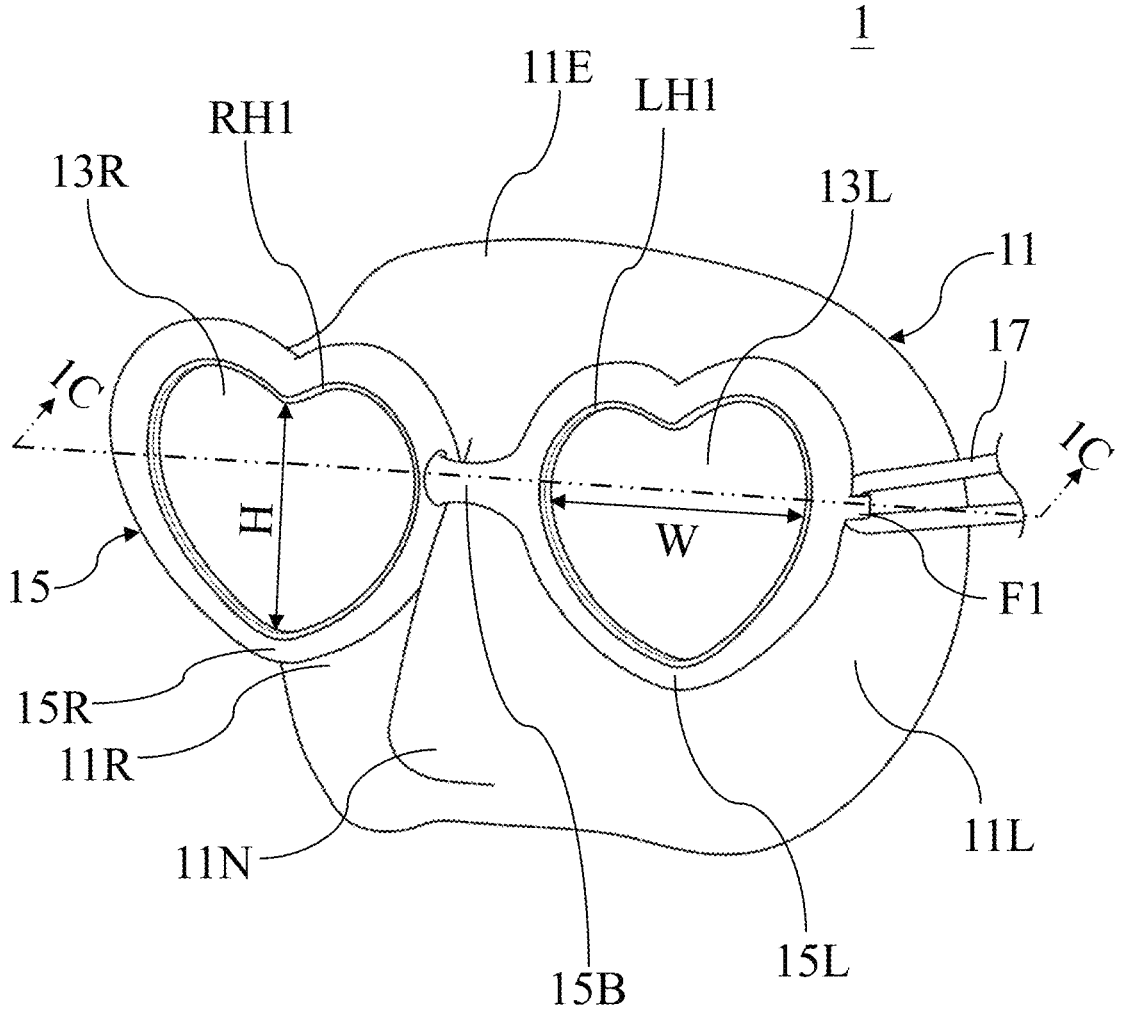
FIG. 1B is a schematic perspective view of the water sports mask in FIG. 1A when the frame is installed onto the waterproof skirt.
Figure 1C:
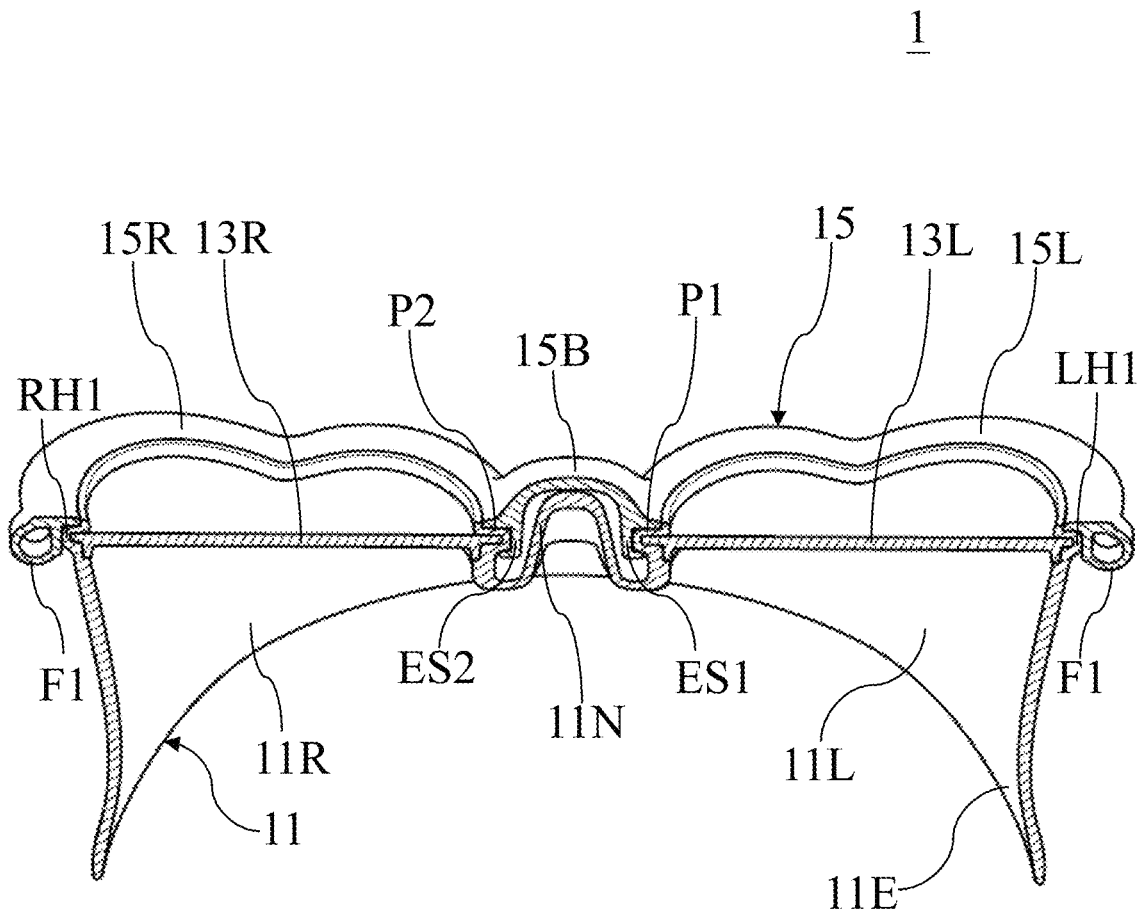
FIG. 1C is a schematic cross-sectional view taken along line 1C-1C in FIG. 1B, showing the connection relationship among components (with the head strap omitted for clarity).
Figure 2A:
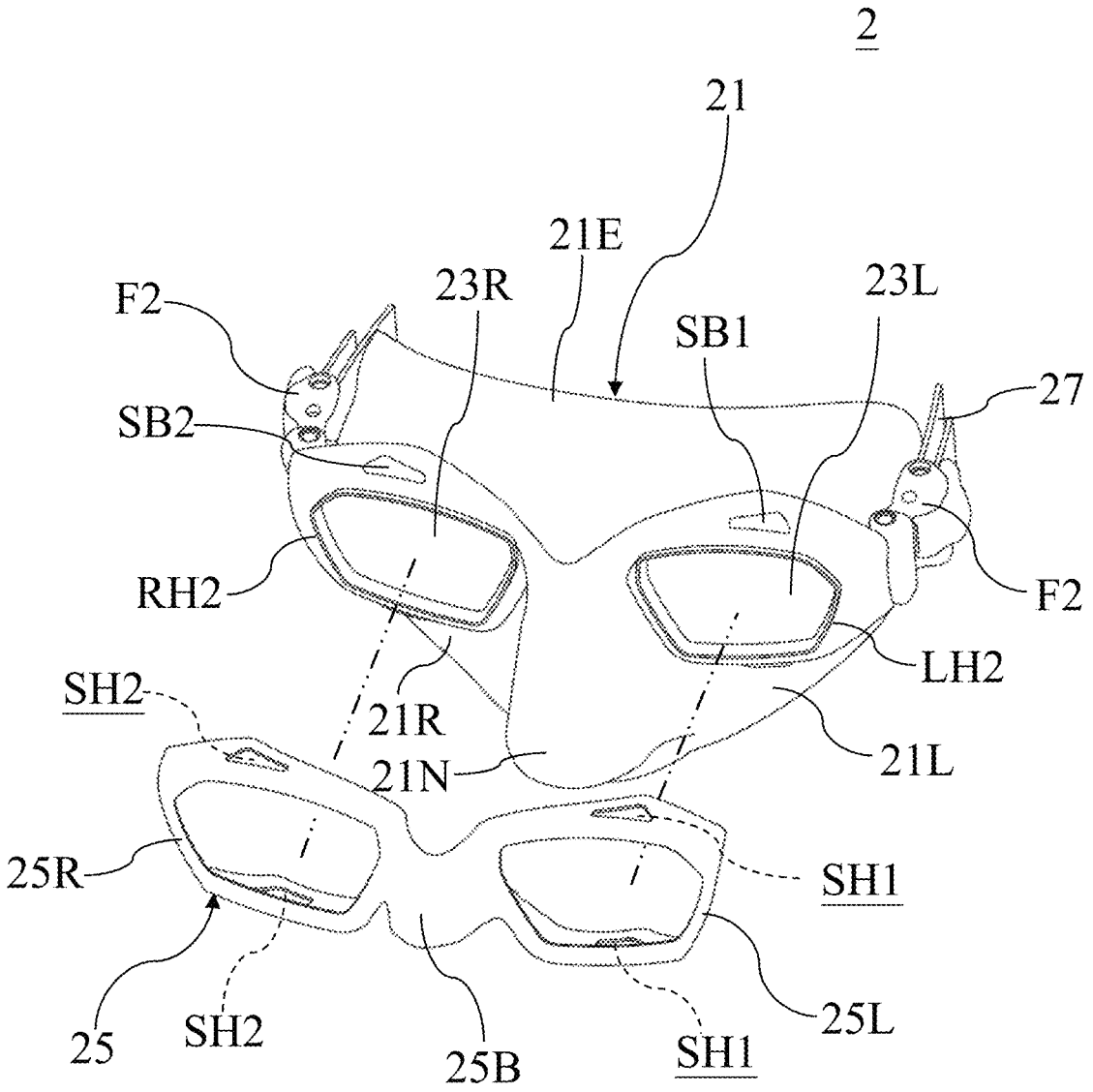
FIG. 2A is a schematic perspective view of a water sports mask (with the head strap partially omitted for clarity) according to a second embodiment of the present invention, in which the frame has not yet been installed onto the waterproof skirt.
Figure 2B:
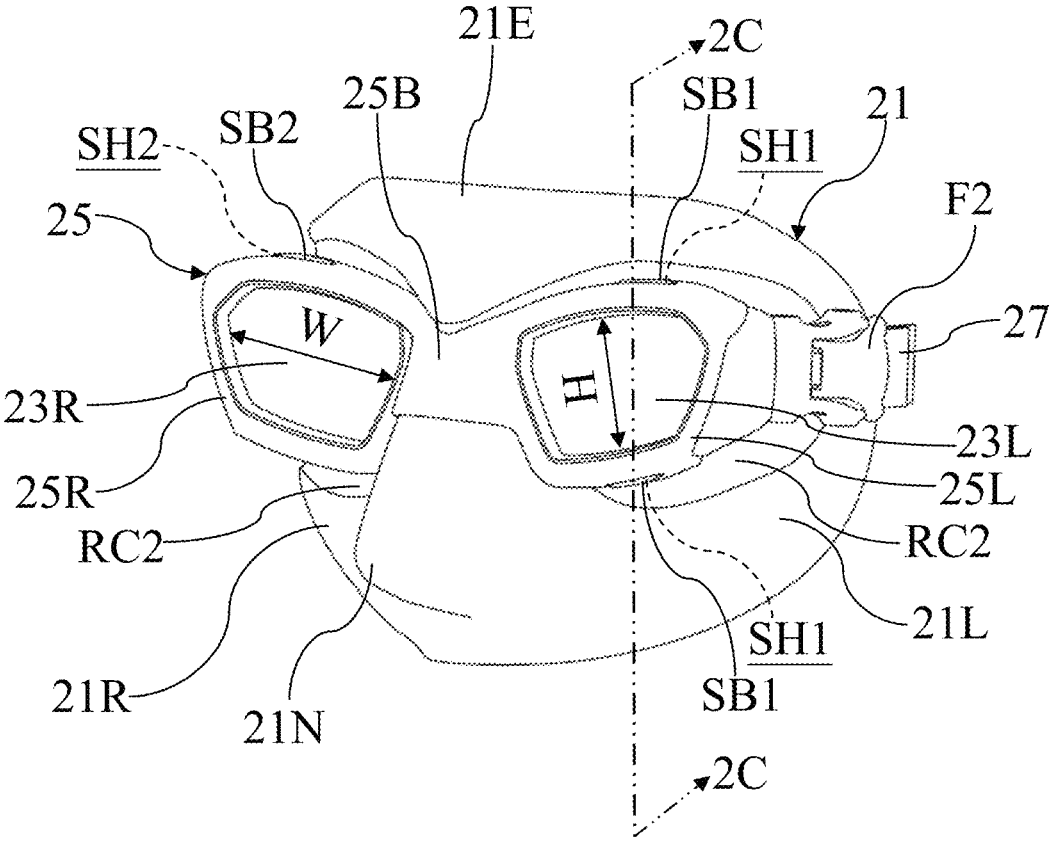
FIG. 2B is a schematic perspective view of the water sports mask in FIG. 2A when the frame is installed onto the waterproof skirt (with the head strap partially omitted for clarity).
Figure 2C:
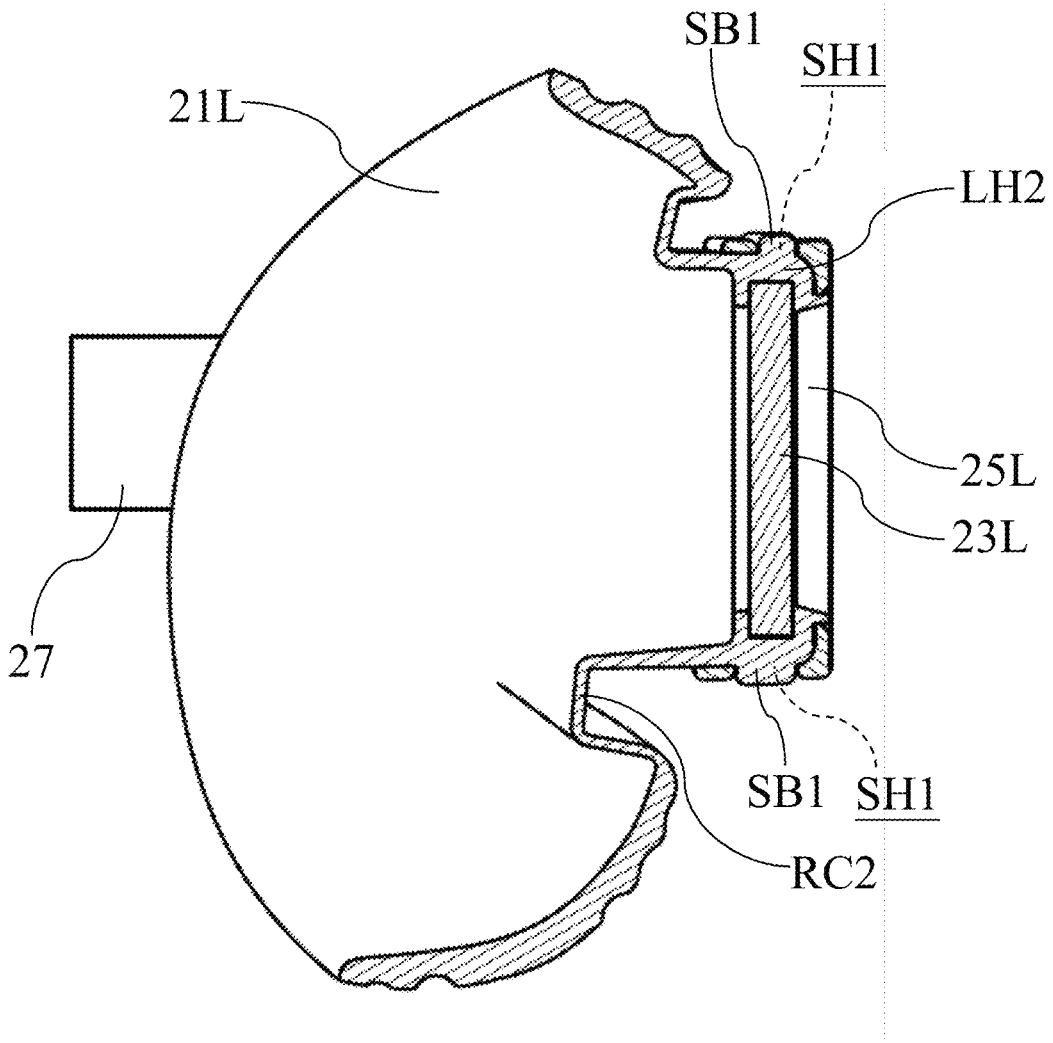
FIG. 2C is a schematic cross-sectional view taken along line 2C-2C in FIG. 2B, showing connection relationship among components.
Figure 3A:
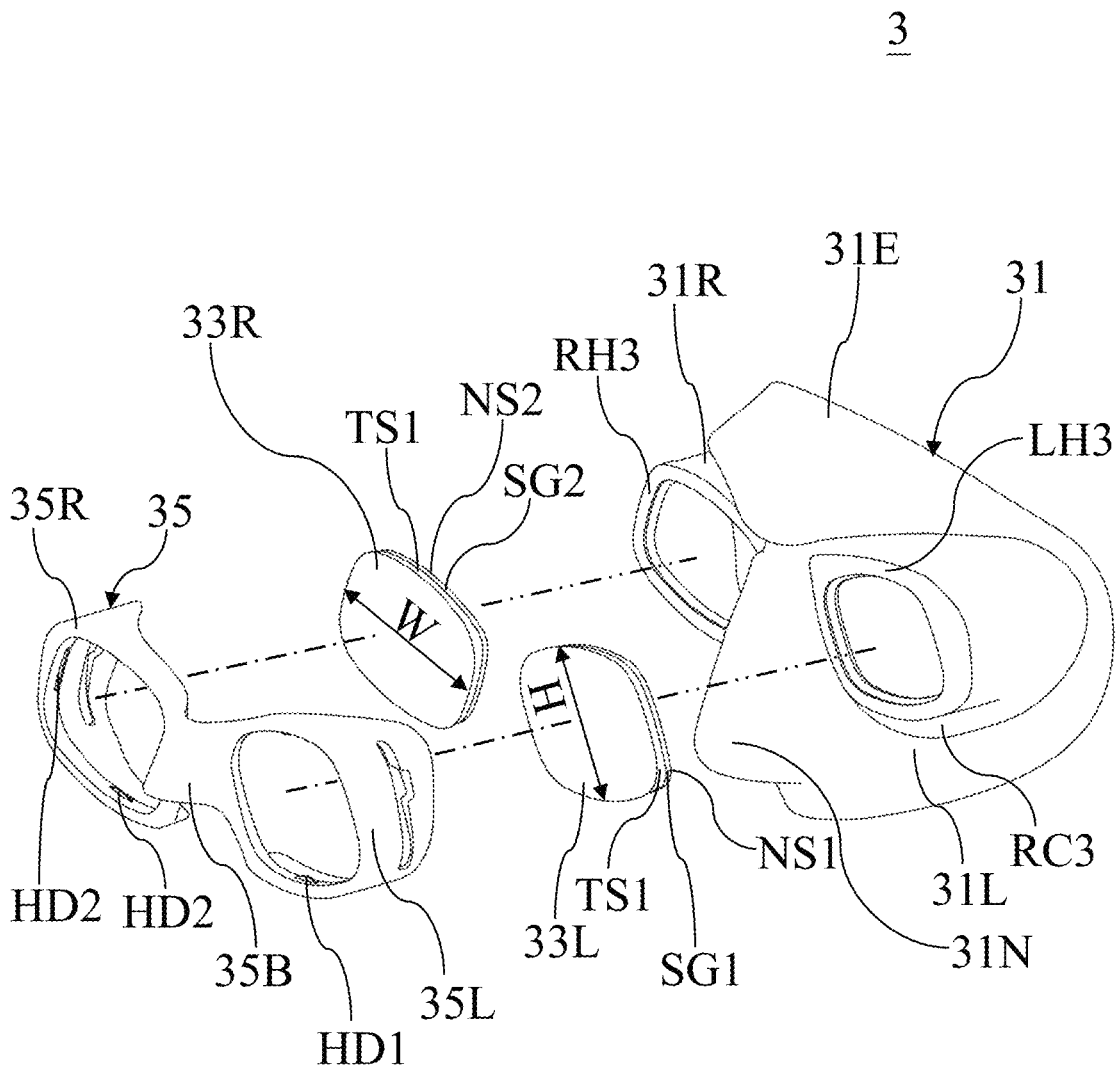
FIG. 3A is a exploded perspective schematic view of a water sports mask (with the head strap omitted for clarity) according to a third embodiment of the present invention.
Figure 3B:
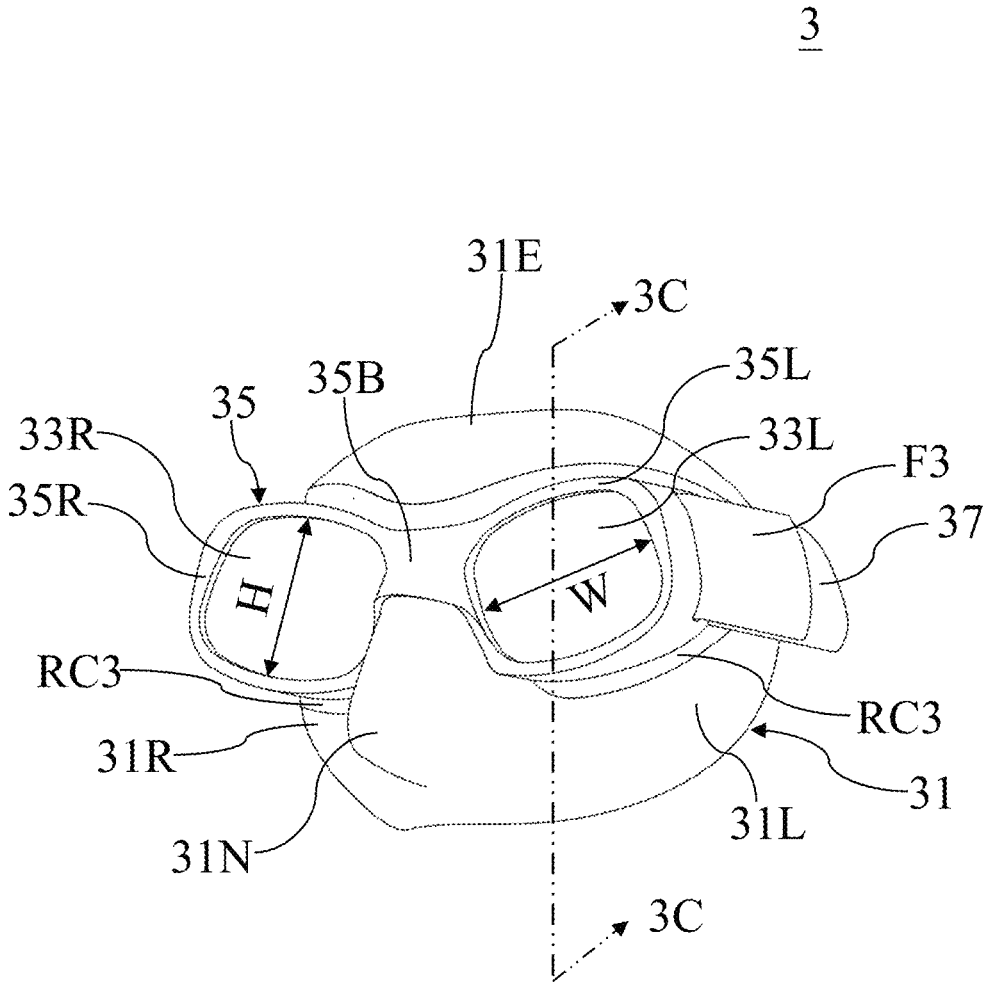
FIG. 3B is a schematic perspective view of the water sports mask in FIG. 3A when being assembled together (with the head strap partially omitted for clarity).
Figure 3C:
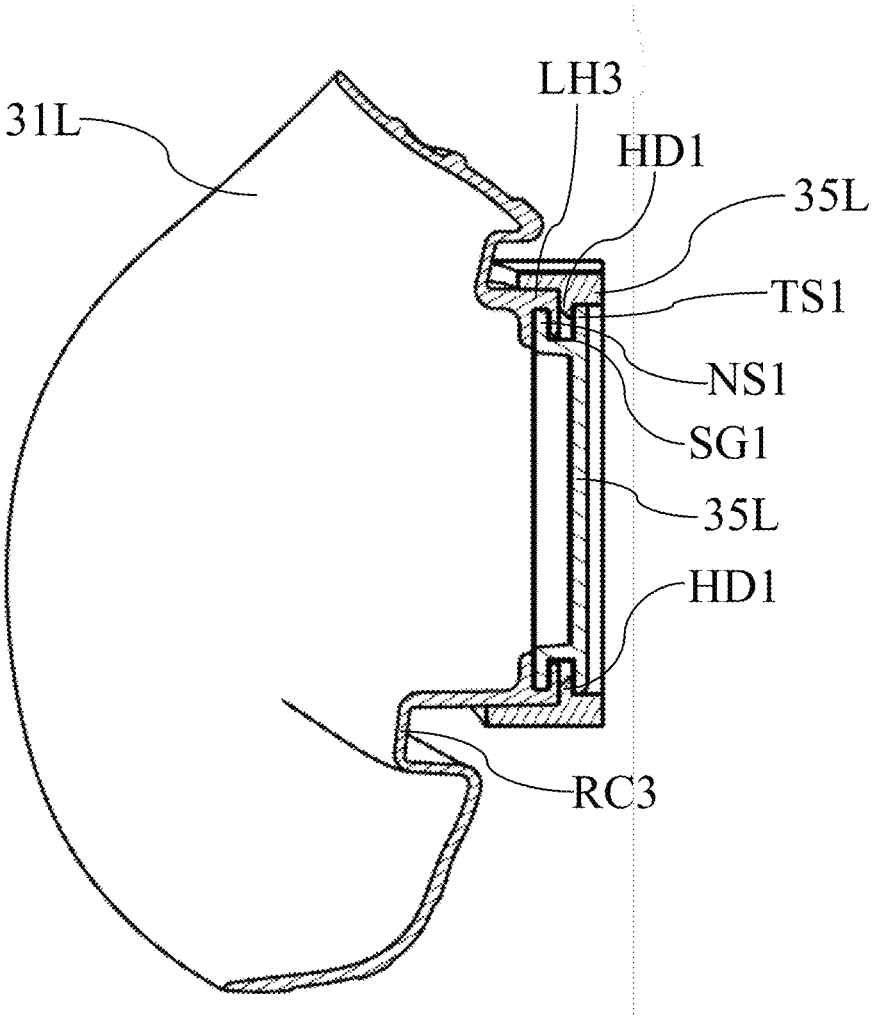
FIG. 3C is a schematic cross-sectional view taken along line 3C-3C in FIG. 3B, showing connection relationship among components.

The common basic structure of the various embodiments of the present invention are described together here and distinguished by different reference numerals, wherein the numerals starting with "1", "2", "3", and "4" correspond to the components of the same name referred to in FIGS. 1A to 1C of the first embodiment, FIGS. 2A to 2C of the second embodiment, FIGS. 3A to 3C of the third embodiment, and FIGS. 4A to 4D of the fourth embodiment, respectively.

A water sports mask 1, 2, 3, 4 includes a waterproof skirt 11, 21, 31, 41, a left viewing window 13L, 23L, 33L, 43L, a right viewing window 13R, 23R, 33R, 43R, a frame 15, 25, 35, 45 and a head strap 17, 27, 37, 47. In order to prevent the main structure of the present invention from being obscured by the head strap, most of the drawings will omit the complete illustration of the head strap.

The waterproof skirt has a left skirt portion 11L, 21L, 31L, 41L, a right skirt portion 11R, 21R, 31R, 41R, a nose covering portion 11N, 21N, 31N, 41N and a rear portion 11E, 21E, 31E, 41E. The left skirt portion 11L, 21L, 31L, 41L and the right skirt portion 11R, 21R, 31R, 41R define a left hollow front portion LH1, LH2, LH3, LH4 and a right hollow front portion RH1, RH2, RH3, RH4, respectively. The nose covering portion 11N, 21N, 31N, 41N is integrally formed between the left skirt portion 11L, 21L, 31L, 41L and the right skirt portion 11R, 21R, 31R, 41R. The rear portion 11E, 21E, 31E, 41E is configured to closely fit around the eyes and nose of a user and isolate the user's mouth outside the waterproof skirt 11, 21, 31, 41. The left viewing window 13L, 23L, 33L, 43L and the right viewing window 13R, 23R, 33R, 43R are embedded with the left hollow front portion LH1, LH2, LH3, LH4 and the right hollow front portion RH1, RH2, RH3, RH4, respectively.

Each of the left viewing window 13L, 23L, 33L, 43L and the right viewing window 13R, 23R, 33R, 43R has a width W ranging from 30 mm to 60 mm, and a height H ranging from 20 mm to 50 mm. The height H preferably ranges from 35 mm to 40 mm and the width W preferably ranges from 45 mm to 50 mm so that after being respectively embedded with the left skirt portion and the right skirt portion, a visible area can still provide with sufficient field of vision. This configuration allows for improved miniaturization and more balanced weight distribution across the entire mask without obstructing the user's required field of vision. The aforementioned width W and height H are perpendicular to each other and are measured as the maximum horizontal dimension and the maximum vertical dimension, respectively, when the user wears the mask.

Preferably, the left viewing window 13L, 23L, 33L, 43L and the right viewing window 13R, 23R, 33R, 43R constitute a two-piece viewing window with separate left and right faceplates, which can also be called a "dual-viewing windows type". Certainly, through an appropriate design, the left viewing window 13L, 23L, 33L, 43L and the right viewing window 13R, 23R, 33R, 43R may be integrally formed into a single faceplate, referred to as a "single-viewing window type" (not shown), which is also feasible. In the embodiment of the single viewing window, the left hollow front portion LH1, LH2, LH3, LH4 and the right hollow front portion RH1, RH2, RH3, RH4 are also in communication with each other, conforming to the design of the single viewing window to achieve the desired water-tightness.

The frame 15, 25, 35, 45 is detachably installed onto the waterproof skirt 11, 21, 31, 41 along the periphery of the left hollow front portion LH1, LH2, LH3, LH4 and the periphery of the right hollow front portion RH1, RH2, RH3, RH4. This design not only enhances the unique appearance of the mask but also allows the frame 15, 25, 35, 45 to be easily detached from the waterproof skirt 11, 21, 31, 41 when not in use. Preferably, the frame 15, 25, 35, 45 may have a left frame 15L, 25L, 35L, 45L, a right frame 15R, 25R, 35R, 45R, and a bridge 15B, 25B, 35B, 45B connecting the left frame 15L, 25L, 35L, 45L and the right frame 15R, 25R, 35R, 45R. The frame 15, 25, 35, 45 may be made of hard material, especially the hard material with a certain flexibility, allowing the frame 15, 25, 35, 45 to withstand expectable bending without easily breaking.

In addition, the peripheral edges of the left hollow front portion LH1, LH2, LH3, LH4 and the right hollow front portion RH1, RH2, RH3, RH4 of the waterproof skirt 11, 21, 31, 41 may have matching contours with the left frame 15L, 25L, 35L, 45L and the right frame 15R, 25R, 35R, 45R, respectively, allowing the assembled appearance as whole to be more coordinated. Of course, it is also feasible that only the peripheral edges of the left hollow front portion LH1, LH2, LH3, LH4 and the right hollow front portion RH1, RH2, RH3, RH4 of the waterproof skirt 11, 21, 31, 41 matching contours with the inner edges of the left frame 15L, 25L, 35L, 45L and the right frame 15R, 25R, 35R, 45R, respectively, as long as the inner edges of the left frame 15L, 25L, 35L, 45L and the right frame 15R, 25R, 35R, 45R are engaged with the peripheral edges of the left hollow front portion LH1, LH2, LH3, LH4 and the right hollow front portion RH1, RH2, RH3, RH4 of the waterproof skirt 11, 21, 31, 41. In this design, the peripheral edges of the left frame 15L, 25L, 35L, 45L and the right frame 15R, 25R, 35R, 45R can also be extended into different shapes to provide more varied styles for users.

Furthermore, any connection structure that can adequately connect the frame 15, 25, 35, 45 to the waterproof skirt 11, 21, 31, 41 and is capable of detachably installing the frame 15, 25, 35, 45 onto the waterproof skirt 11, 21, 31, 41 is a feasible alternative and fall within the scope of the present invention.

The head strap 17, 27, 37, 47 may run backward along a left side and a right side of the waterproof skirt 11, 21, 31, 41. The head straps 17, 27, 37, 47 may be fastened to the waterproof skirt 11, 21, 31, 41 or the frame 15, 25, 35, 45 through an additional fastener, or can be directly fastened to the connection structure of the waterproof skirt 11, 21, 31, 41 or the frame 15, 25, 35, 45, which are all feasible.

In order to make the description clear and easy to understand, the above description only provides a preliminary description of the common features of various embodiments of the present invention. The differences and features of various embodiments of the present invention will be further described below, and the common features mentioned above will not be further described.

The first embodiment of the present invention is shown in FIGS. 1A to 1C, which depict the water sports mask 1. The left frame 15L of the frame 15 may have at least one first engaging slot ES1 for accommodating a first periphery P1 of the left hollow front portion LH1 of the waterproof skirt 11, and the right frame 15R of the frame 15 may have at least one second engaging slot ES2 for accommodating a second periphery P2 of the right hollow front portion RH1 of the waterproof skirt 11. Preferably, the left frame 15L has three first engaging slots ES1 evenly distributed on the left frame 15L, and the right frame 15R has three second engaging slots ES2 evenly distributed on the right frame 15R.

When the frame 15 is installed onto the waterproof skirt 11, the first engaging slots ES1 and the second engaging slots ES2 correspondingly accommodate the first periphery P1 of the left hollow front portion LH1 and the second periphery P2 of the right hollow front portion RH1 of the waterproof skirt 11. The user only needs to slightly flex the frame 15 to disengage the first engaging slots ES1 and the second engaging slots ES2 from the first periphery P1 and the second periphery P2 respectively, thereby allowing the frame 15 to be detached from the waterproof skirt 11. As such, the waterproof skirt 11 can be folded in half by virtue of the soft material between the left viewing window 13L and the right viewing window 13R for storage, which is more convenient to carry.

In addition, when the frame 15 is made of hard material with a certain flexibility, the left frame 15L may have a single first engaging slot ES1 formed with a continuous annular configuration, allowing the first periphery P1 of the left hollow front portion LH1 to be entirely accommodated therein, and the right frame 15R may have a single second engaging slot ES2 formed with a continuous annular configuration, allowing the second periphery P2 of the right hollow front portion RH1 to be entirely accommodated therein. In this way, the frame 15 is able to be more firmly engaged with the waterproof skirt 11 and is not easily separated due to external forces during water activities.

In addition, in this embodiment, the connection structures F1 may be provided on the left and right sides of the frame 15 for the head strap 17 to be directly fastened thereto.

The second embodiment of the present invention is shown in FIGS. 2A to 2C, which depict the water sports mask 2. The left frame 25L of the frame 25 has at least one first snap hole SH1, and the right frame 25R of the frame 25 has at least one second snap hole SH2 Correspondingly, the left skirt portion 21L of the waterproof skirt 21 has at least one first snap block SB1, and the right skirt portion 21R of the waterproof skirt 21 has at least one second snap block SB2 In this way, when the frame 25 is installed onto the waterproof skirt 21, the at least one first snap block SB1 is correspondingly engaged in the at least one first snap hole SH1, and at least one second snap block SB2 is correspondingly engaged in at least one second snap hole SH2.

Preferably, as shown in FIGS. 2A to 2C, the left frame 25L has two first snap holes SH1, respectively located at the upper frame section and the lower frame section of the left frame 25L, and the right frame 25R has two second snap holes SH2, respectively located at the upper frame section and the lower frame section of the right frame 25R. Correspondingly, the left skirt portion 21L has two first snap blocks SB1, respectively located at the upper portion and the lower portion of the left skirt portion 21L, and the right skirt portion 21R has two second snap blocks SB2 respectively located at the upper portion and the lower portion of the right skirt portion 21R.

Of course, in other embodiments, the present invention may also adopt other male and female configurations, such as the snap holes are provided on the left and right skirt portions, and the snap blocks are provided on the left and right frames. In this type of male-female configuration, when the frame 25 is assembled to the waterproof skirt 21, the first snap block SB1 and the second snap block SB2 are correspondingly engaged in the first snap hole SH1 and the second snap hole SH2, respectively. The user only needs to slightly press the first snap block SB1 and the second snap block SB2 to disengage them from the first snap hole SH1 and the second snap hole SH2 respectively, thereby allowing the frame the frame 25 to be detached from the waterproof skirt 21. As such, the waterproof skirt 21 can be folded in half by virtue of the soft material between the left viewing window 23L and the right viewing window 23R for storage, which is more convenient to carry.

The waterproof skirt 21 may further include a recessed portion RC2 extending along at least one portion of the outer contour of the frame 25. In the best mode, the recessed portion RC2 extends continuously along the outer contour of the frame 25, like a hollow reinforced rib to more accurately align with the user's eye sockets. This design can not only increase the stability of the structure of the water sports mask 2, but also enhances stability when worn.

In addition, in this embodiment, fasteners F2 are provided on both sides of the waterproof skirt 21, respectively, to allow the head strap 27 to be fastened to them.

The third embodiment of the present invention is shown in FIGS. 3A to 3C, which depict the water sports mask 3. The water sports mask 3 further provides another assembling structure for the waterproof skirt 31, the left viewing window 33L, the right viewing window 33R and the frame 35.

The left viewing window 33L has a first side groove SG1 defined by a first outer sidewall TS1 and a first inner sidewall NS1 opposite to the first outer sidewall TS1. Similarly, the right viewing window 33R has a second side groove SG2 defined by a second outer sidewall TS2 and a second inner sidewall NS2 opposite to the second outer sidewall TS2.

The first inner sidewall NS1 and the second inner sidewall NS2 are embedded in the left hollow front portion LH3 and the right hollow front portion RH3 of the waterproof skirt 31, respectively. The left frame 35L of the frame 35 has at least one first hold-down HD1 for engaging with the first outer sidewall TS1 of the first side groove SG1 and the right frame 35R of the frame 35 has at least one second hold-down HD2 for engaging with the second outer sidewall TS2 of the second side groove SG2 to fix the frame 35 onto the waterproof skirt 31. In this way, the user only needs to slightly flex the frame 35 to separate the first hold-down HD1 and the second hold-down HD2 from the first outer sidewall TS1 and the second outer sidewall TS2, respectively, thereby allowing the frame 35 to be detached from the waterproof skirt 31. As such, the waterproof skirt 31 can be folded in half by virtue of the soft material between the left viewing window 33L and the right viewing window 33R for storage, which is more convenient to carry.

Preferably, the left frame 35L has three first hold-downs HD1 evenly distributed on the left frame 35L, and the right frame 35R has three second hold-downs HD2 evenly distributed on the right frame 35R.

Likewise, the waterproof skirt 31 may further include a recessed portion RC3 extending along at least one portion of the outer contour of the frame 35. In the best mode, the recessed portion RC3 extends continuously along the outer contour of the frame 35, like a hollow reinforced rib to more accurately align with the user's eye sockets. This design can not only increase the stability of the structure of the water sports mask 3, but also enhances stability when worn.

In addition, in this embodiment, fasteners F3 are provided on both sides of the waterproof skirt 31, respectively, to allow the head strap 37 to be fastened to them.

The fourth embodiment of the present invention is shown in FIGS. 4A to 4D, which depict the water sports mask 4. The water sports mask 4 further provides another assembling structure of the waterproof skirt 41 and the frame 45.

In detail, the water sports mask 4 further includes a pivotable device PD disposed on two opposing outer sides of the frame 45 to detachably install the frame 45 onto the waterproof skirt 41.

Figure 4A:
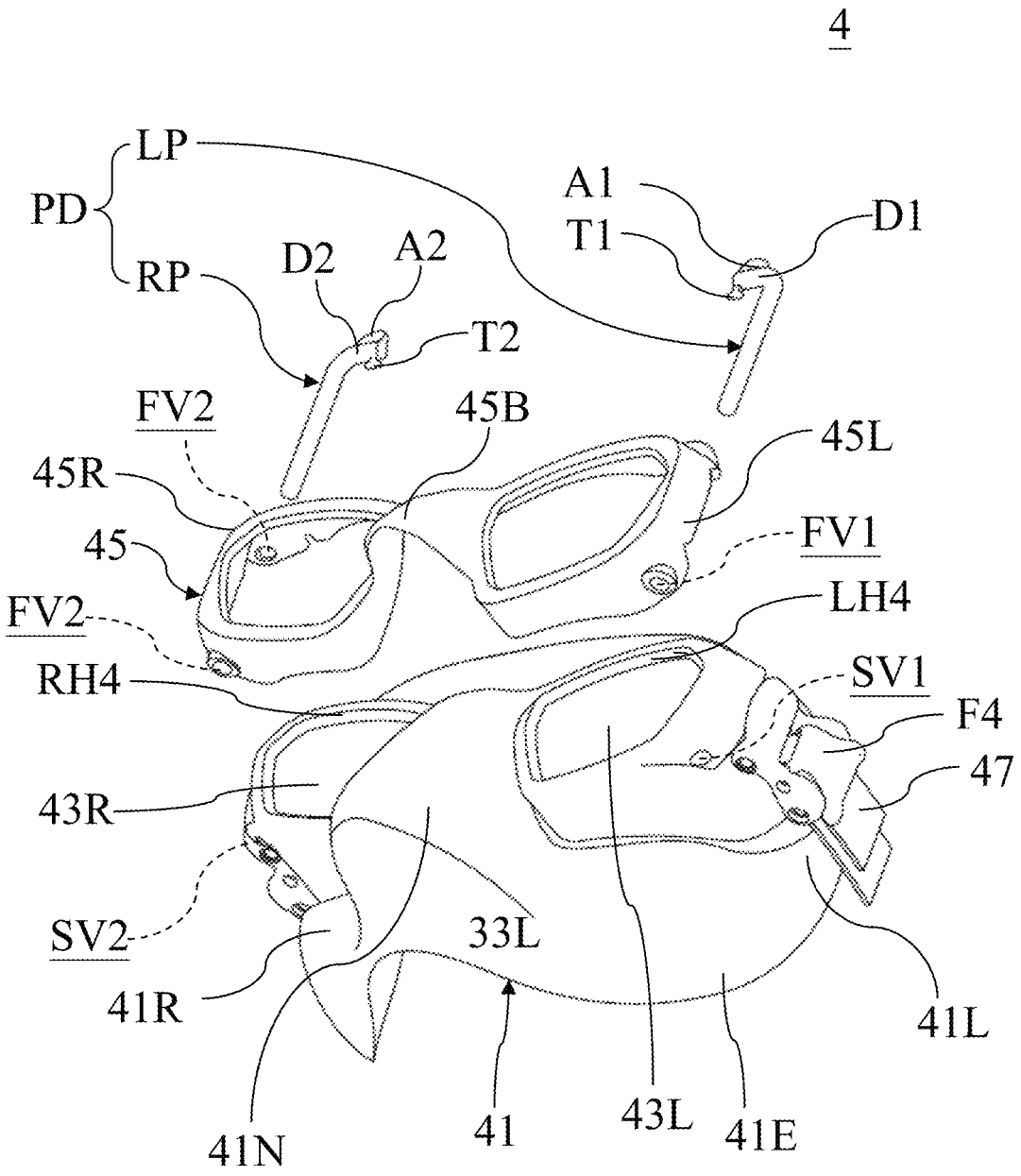
FIG. 4A is a schematic perspective view of a water sports mask (with the head strap omitted for clarity) according to a fourth embodiment of the present invention, in which the frame has not yet been installed onto the waterproof skirt through a pivotable device.
Figure 4B:
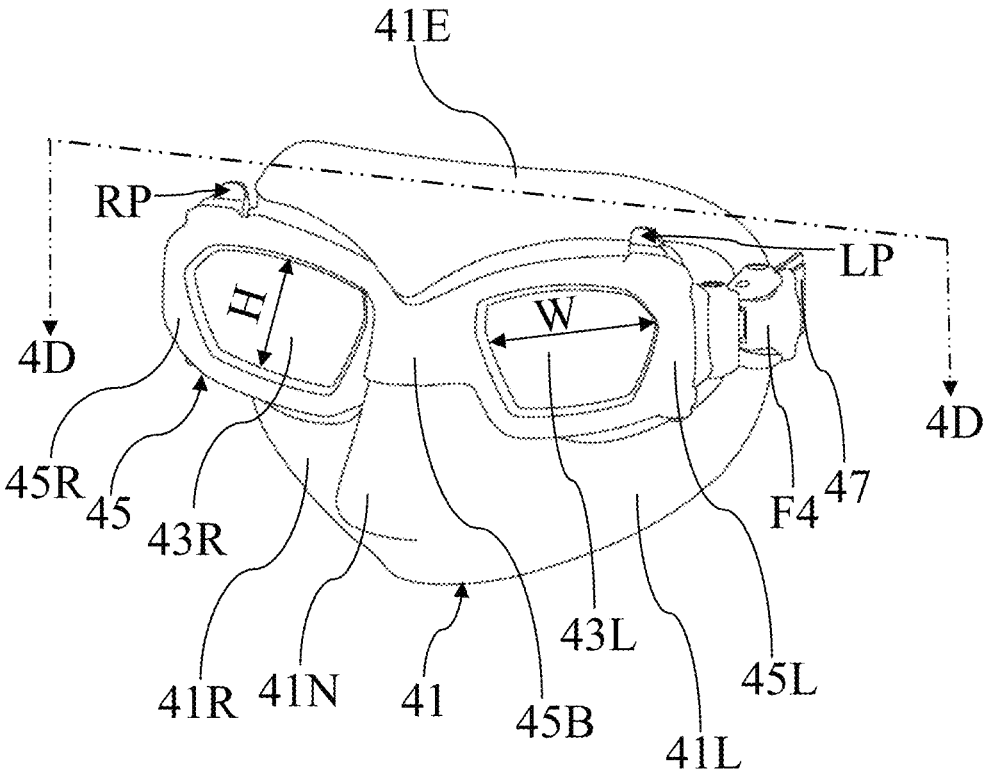
FIG. 4B is a schematic perspective view of the water sports mask in FIG. 4A when the frame is installed onto the waterproof skirt through the pivotable device (with the head strap partially omitted for clarity).
Figure 4C:
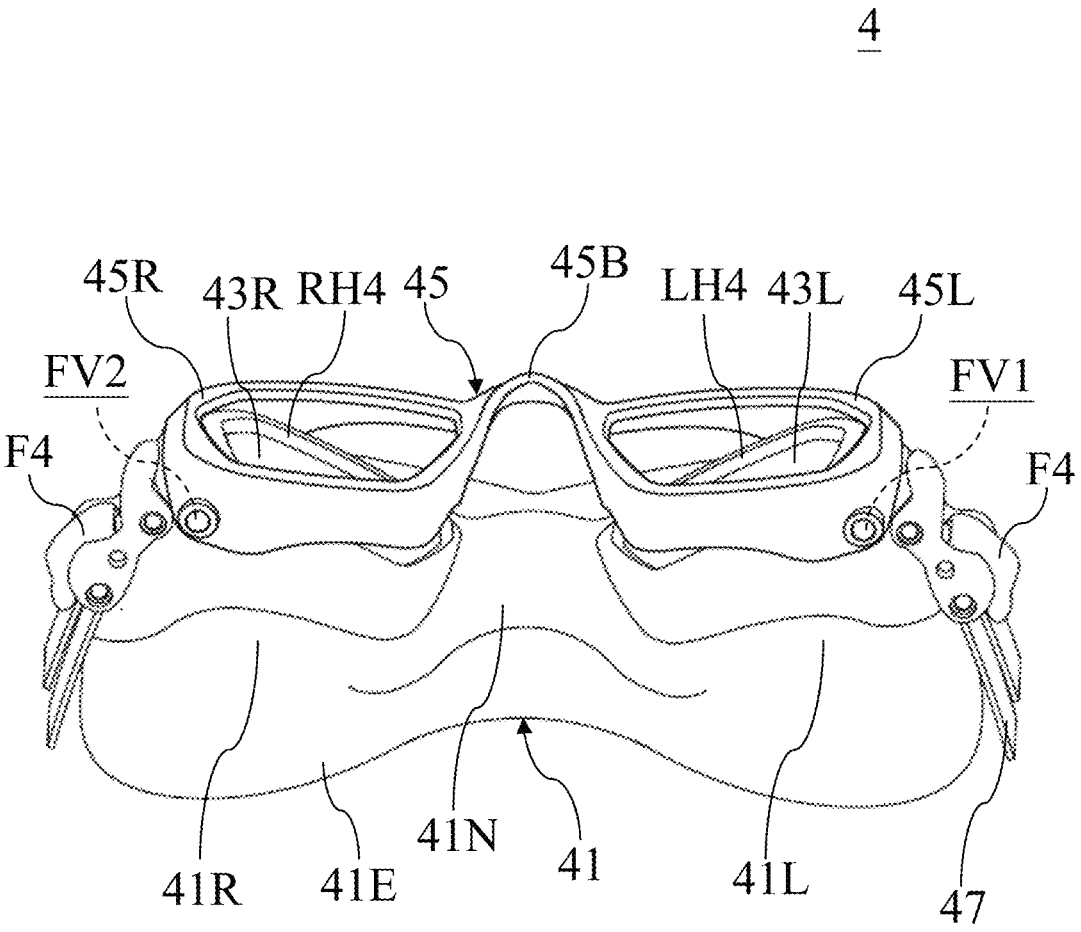
FIG. 4C is a schematic perspective view of the water sports mask of FIG. 4B from another perspective, showing that the waterproof skirt is partially separated from the frame in a pivotable manner.

Preferably, the pivotable device PD includes a left pin LP and a right pin RP. For example, as shown in FIG. 4A, the left pin LP and the right pin RP each have a substantially cane-shaped structure, or a shape similar to the number "7." The left pin LP is inserted through the outer side vias FV1 of the left frame 45L and the outer side vias SV1 of the left skirt portion 41L. The right pin RP is inserted through the outer side vias FV2 of the right frame 45R and the outer side vias SV2 of the right skirt portion 41R. In this way, the waterproof skirt 41 and the frame 45 can pivot relative to each other along the left pin LP and the right pin RP, as shown in FIG. 4C.

This design is based on the consideration that the frame 45 is mostly made of hard material, while the waterproof skirt 41 is made of soft material. Therefore, the frame 45 and the waterproof skirt 41 are connected only at the corresponding two outer sides (the outer side of the left frame 45L corresponds to the outer side of the left skirt portion 41L, and the outer side of the right frame 45R corresponds to the outer side of the right skirt portion 41R), allowing the waterproof skirt 41 to more closely fit the user's face without being constrained by the hard frame 45 so as to provide great comfort and better watertightness when worn.

Figure 4D:
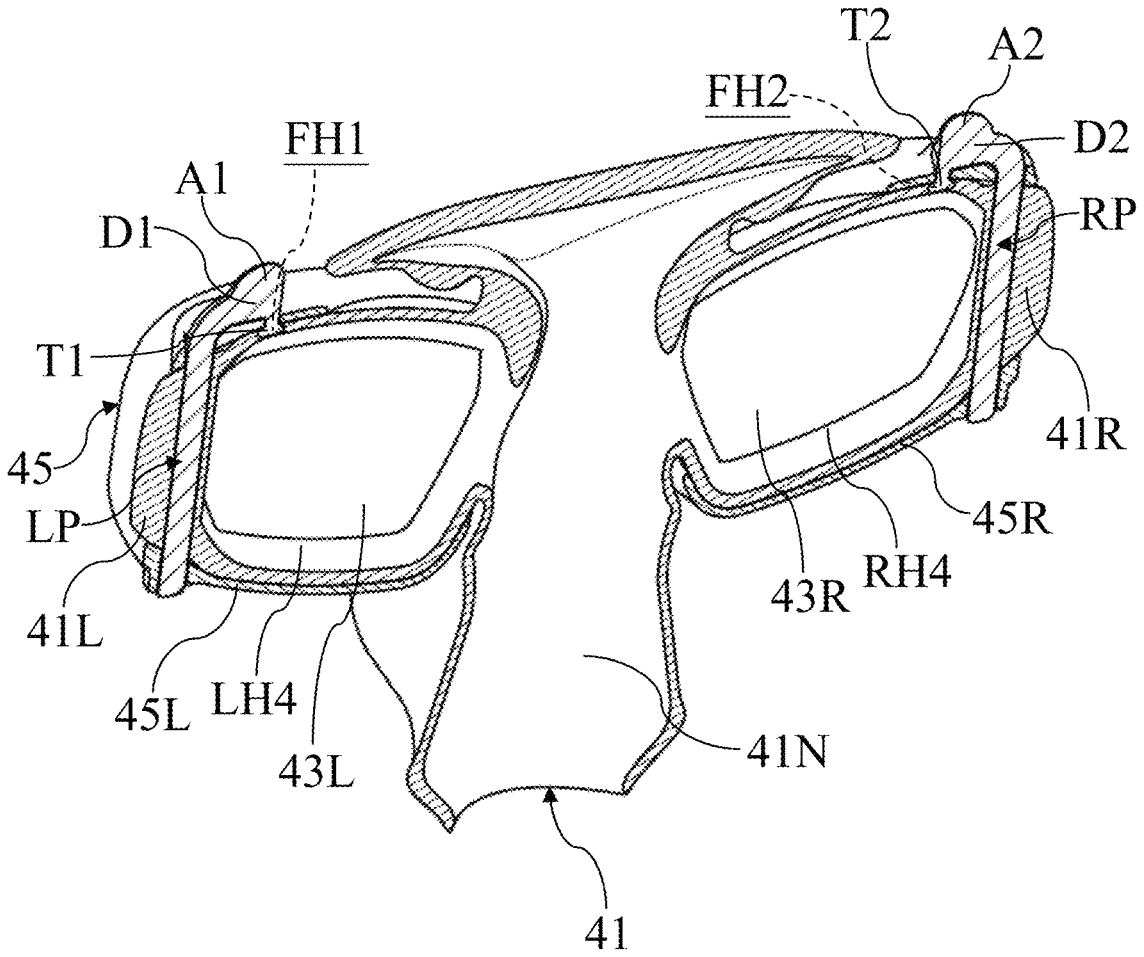
FIG. 4D is a schematic cross-sectional view taken along line 4D-4D of FIG. 4B, showing connection relationship among components.

A preferred pivoting structure of the pivotable device PD is shown in FIG. 4D. The left frame 45L may be provided with a first fixed hole FH1, and the right frame 45R may be provided with a second fixed hole FH2. In addition, a first head D1 of the left pin LP may have a first latch T1, and a second head D2 of the right pin RP may have a second latch T2. In this way, the first latch T1 and the second latch T2 can be suitably inserted into the first fixed hole FH1 and the second fixed hole FH2, respectively, to lock the left pin LP and the right pin RP on the left frame 45L and the right frame 45R to prevent the frame 45 from being completely separated from the waterproof skirt 41.

Preferably, the first head D1 of the left pin LP may further have a first handle A1, and the second head D2 of the right pin RP may further have a second handle A2. In this pivot structure, when the frame 45 has been installed onto the waterproof skirt 41 and the user wants to detach the frame 45, the user can suitably exert through his fingers to pull the first handle A1 of the left pin LP and the second handle A2 of the right pin RP to disengage the first latch T1 and the second latch T2 from the first fixed hole FH1 and the second fixed hole FH2, respectively, and then the left pin LP and the right pin RP can be pulled out. At this time, the frame 45 can be completely separated from the waterproof skirt 41, as shown in FIG. 4A. Therefore, this pivot structure makes the frame 45 easy to install onto and detach from the waterproof skirt 41.

In addition, in this embodiment, fasteners F4 are provided on both sides of the waterproof skirt 41, respectively, to allow the head strap 47 to be fastened to them.

The focus of the present invention is to provide a detachable compact frame that allows users to install it onto a waterproof skirt, for example, of a snorkel mask. This design not only reduces the weight and volume of the entire mask, but also allows the frame to be designed in various styles for users to interchange, thereby enhancing the versatility of style and color combinations, and further increasing consumers' purchasing desire without affecting the original comfort and watertightness of the mask.

The technical principles of the present invention have been described above. Other aspects, such as the design of the head strap, the selection of materials, the type of equipment to which it is applied, or variations in the configuration of left and right viewing windows, are not the focus of concern. As a result, any modifications based on the above core technology of the present invention are intended to be protected.

The foregoing embodiments are used only to illustrate the implementations of the present invention and to explain the technical features of the present invention, and are not used to limit the scope of the present invention. Any modifications or equivalent arrangements that can be easily accomplished by those skilled in the art are considered to fall within the scope of the present invention.

What is claimed is:

1. A water sports mask, comprising:

a waterproof skirt having:

a left skirt portion defining a left hollow front portion;

a right skirt portion defining a right hollow front portion;

a nose covering portion integrally formed between the left skirt portion and the right skirt portion; and a rear portion being configured to fit around eyes and a nose of a user only;

a left viewing window, embedded with the left hollow front portion;

a right viewing window, embedded with the right hollow front portion;

a head strap running backward along a left side and a right side of the waterproof skirt;

characterized in that:

the left viewing window and the right viewing window each have a width ranging from 30 mm to 60 mm, and a height ranging from 20 mm to 50 mm; and the water sports mask further has a frame which is detachably installed onto the waterproof skirt along peripheries of the left hollow front portion and the right hollow front portion thereof.

2. The water sports mask of claim 1, wherein the left viewing window and the right viewing window constitute a two-piece viewing window with separate left and right faceplates.

3. The water sports mask of claim 2, wherein the frame comprises a left frame, a right frame and a bridge connecting the left frame and the right frame, and peripheral edges of the left hollow front portion and the right hollow front portion of the waterproof skirt have matching contours with the left frame and the right frame, respectively.

4. The water sports mask of claim 3, wherein the left frame has at least one first engaging slot for accommodating a first periphery of the left hollow front portion, and the right frame has at least one second engaging slot for accommodating a second periphery of the right hollow front portion.

5. The water sports mask of claim 4, wherein the at least one first engaging slot of the left frame comprises three first engaging slots evenly distributed on the left frame, and the at least one second engaging slot of the right frame comprises three second engaging slots evenly distributed on the right frame.

6. The water sports mask of claim 3, wherein the left frame has at least one first snap hole, and the right frame has at least one second snap hole, and wherein the left skirt portion has at least one first snap block, and the right skirt portion has at least one second snap block so that when the frame is installed onto the waterproof skirt, the at least one first snap block is correspondingly engaged in the at least one first snap hole, and the at least one second snap block is correspondingly engaged in the at least one second snap hole.

7. The water sports mask of claim 6, wherein the at least one first snap hole of the left frame includes two first snap holes, respectively located at an upper frame section and a lower frame section of the left frame, and the at least one second snap hole of the right frame includes two second snap holes, respectively located at an upper frame section and a lower frame section of the right frame, and wherein the at least one first snap block of the left skirt portion includes two first snap blocks, respectively located at an upper portion and a lower portion of the left skirt portion, and the at least one second snap block of the right skirt portion includes two second snap blocks, respectively located at an upper portion and a lower portion of the right skirt portion.

8. The water sports mask of claim 6, wherein the waterproof skirt further includes a recessed portion extending along at least one portion of the outer contour of the frame.

9. The water sports mask of claim 3, wherein:

the left viewing window has a first side groove defined by a first outer sidewall and a first inner sidewall opposite to the first outer sidewall;

the right viewing window has a second side groove defined by a second outer sidewall and a second inner sidewall opposite to the second outer sidewall;

the first inner sidewall and the second inner sidewall are embedded in the left hollow front portion and the right hollow front portion, respectively; and the left frame has at least one first hold-down for engaging with the first outer sidewall of the first side groove, and the right frame has at least one second hold-down for engaging with the second outer sidewall of the second side groove to fix the frame onto the waterproof skirt.

10. The water sports mask of claim 9, wherein the at least one first hold-down of the left frame comprises three first hold-downs evenly distributed on the left frame, and the at least one second hold-down of the right frame comprises three second hold-downs evenly distributed on the right frame.

11. The water sports mask of claim 9, wherein the waterproof skirt further includes a recessed portion extending along at least one portion of the outer contour of the frame.

12. The water sports mask of claim 3, further comprising a pivotable device disposed on two opposing outer sides of the frame for detachably installing the frame onto the waterproof skirt.

13. The water sports mask of claim 12, wherein the pivotable device comprises a left pin and a right pin each having a substantially cane-shaped structure, wherein the left pin is inserted through outer side vias of the left frame and the left skirt portion, and the right pin is inserted through outer side vias of the right frame and the right skirt portion so that the waterproof skirt and the frame are configured to pivot relative to each other along the left pin and the right pin.

14. The water sports mask of claim 13, wherein:

the left frame is provided with a first fixed hole, and the right frame is provided with a second fixed hole; and a first head of the left pin has a first latch, and a second head of the right pin has a second latch so that the first latch and the second latch are inserted into the first fixed hole and the second fixed hole, respectively, to lock the left pin and the right pin on the left frame and the right frame to prevent the frame from being completely separated from the waterproof skirt.

* * * * *